US007021793B2

(12) United States Patent
Biasoli et al.

(10) Patent No.: US 7,021,793 B2
(45) Date of Patent: Apr. 4, 2006

(54) GROUND-EMBEDDED AIR COOLED LIGHTING DEVICE, IN PARTICULAR FLOODLIGHT OR SEALED LAMP

(76) Inventors: Francesco Biasoli, 06250 Hougins-Domaine des Pins-Av., Du Font Roubent, 890 (FR); Francis Roche, 43 Domaine de l'Istre, 06530, Le Tignet (FR)

( * ) Notice: Subject to any disclaimer, the term of this patent is extended or adjusted under 35 U.S.C. 154(b) by 72 days.

(21) Appl. No.: 10/440,893

(22) Filed: May 19, 2003

(65) Prior Publication Data

US 2004/0156191 A1 Aug. 12, 2004

(30) Foreign Application Priority Data

Feb. 12, 2003 (EP) ..... 03425084

(51) Int. Cl.
*F21V 29/00* (2006.01)

(52) U.S. Cl. ..... 362/267; 362/153.1; 362/294; 362/373

(58) Field of Classification Search ..... 362/153.1, 362/263, 264, 267, 294, 373
See application file for complete search history.

(56) References Cited

U.S. PATENT DOCUMENTS

| | | | | |
|---|---|---|---|---|
| 4,984,139 | A * | 1/1991 | Goggia | 362/153.1 |
| 5,083,253 | A * | 1/1992 | Hahnel | 362/306 |
| 5,479,322 | A * | 12/1995 | Kacheria | 362/32 |
| 5,887,966 | A * | 3/1999 | Eissner et al. | 362/153.1 |
| 5,934,783 | A * | 8/1999 | Yoshikawa | 362/96 |
| 6,068,384 | A * | 5/2000 | Tyson et al. | 362/153.1 |

* cited by examiner

*Primary Examiner*—John Anthony Ward
(74) *Attorney, Agent, or Firm*—Gordon E. Gray, III

(57) ABSTRACT

The present invention is a ground-embedded, air-cooled lighting device. In particular, the present invention is directed to a floodlight or sealed lamp. A preferred embodiment of the floodlight comprises a sealed casing having an exterior wall and contains air. The sealed casing holds a disc element supporting a translucid material and a tube spaced from the exterior wall. The tube is preferably concentrically mounted within the casing. The tube surrounds an optical reflector, a light source mounted at the reflector's focus and aimed at the disc element, and a power supply for the light source. The sealed casing further contains a fan, preferably aimed a portion of the exterior wall having increased thermal conductivity. The fan circulates air in the casing through the tube and past the disc element for cooling purposes.

13 Claims, 4 Drawing Sheets

GROUND-EMBEDDED AIR COOLED LIGHTING DEVICE, IN PARTICULAR FLOODLIGHT OR SEALED LAMP

BACKGROUND OF THE INVENTION

The present invention relates to a lighting device, in particular a floodlight such as a sealed lamp embedded in the ground.

It is already known in the art a lighting device, in particular a floodlight such as a sealed lamp embedded in the ground, emitting a directional frontward directed light beam, said prior device comprising:

1. an optical reflector,
2. a light source installed at the focus of the optical reflector,
3. an electric power supply unit for power supplying the light source,
4. a disc element supporting a translucid material for allowing light to be outward directed.

The above mentioned elements are arranged in a sealed casing provided for use in outside environments, in particular adapted to be embedded in the ground in a receiving well defining a volume suitable to house the device therein.

A drawback of this prior lighting device is constituted by the comparatively high heating of the translucid material contacting the outside environment and provided for transmitting the optical light beam.

This heating, which is essentially due to the heat emitted by the light source, generates very high temperatures which are very dangerous for persons susceptible to contact such an unprotected surface.

This would be particularly objectable as the lighting device is installed at places available to the public.

Standardized devices have been designed for controlling the above type of danger, and the standardized devices, in particular, has been standardized depending on their use conditions.

On the other hand, since it is essential to have the surface of the lighting device contacting the outside environment as smooth as possible for preventing, for example, any accumulation of powder, liquids and so on, susceptible to obstruct the emitted optical light beam, it would not be suitable to prevent the hot surface of the lighting device from being accessed by using a mechanical means such as a protective grid.

SUMMARY OF THE INVENTION

Thus, the aim of the present invention is to provide such a lighting device, in particular a sealed floodlight, provided to be embedded into the ground, and allowing to greatly reduce the temperature of the translucid material, to prevent the latter from injuring people.

To achieve the above mentioned aim, as well as yet other objects, which will become more apparent hereinafter, the invention provides a lighting device of the above mentioned type, characterized in that said lighting device comprises an electric fan generating an air flow directed through a closed loop or circuit inside the lighting device.

The air flow, in particular, is so optimized as to eliminate any hot spots, in particular at the level of the translucid material for transmitting to the outside environment the light beam and, on the other hand, for enhancing the outward thermal dissipation of heat, and this owing to the provision of an outer casing formed by a material having a very good thermal conductivity.

Moreover, the invention provides to greatly reduce the temperature of the electric components such as ballast, capacitor, limiting elements and so on as required for a proper operation of the light source, as said components are integrated in the housing of the lighting device.

More specifically, the fan is designed for sucking hot air heated by the light source, in particular a discharge lamp, the mentioned electric components or elements, in particular of a ballast type, assuring a proper operation of the light source.

After having passed through the above mentioned fan, the hot air is caused to impinge on the bottom portion of the lighting device, thereby providing an optimum thermal exchange with the outer envelope or casing made of a very high thermal conductivity material.

The thus cooled air flow is then conveyed to the top portion of the lighting device through a mechanical type of guiding or conveying device: this air will contact, at the top portion, the translucid material for outward directing the light beam, thereby greatly reducing the temperature of the latter.

In this connection it should be pointed out that the air flows can have two direction.

Since the ventilation system operates as a closed loop or circuit, the sealing properties of the lighting device, as this is required, are not modified by the provision of the subject cooling system.

BRIEF DESCRIPTION OF THE DRAWINGS

The present invention will be disclosed thereinbelow in a more detailed manner with reference to the schematic diagram shown in FIG. 1 of the accompanying drawings.

DESCRIPTION OF THE PREFERRED EMBODIMENTS

Figure 1:
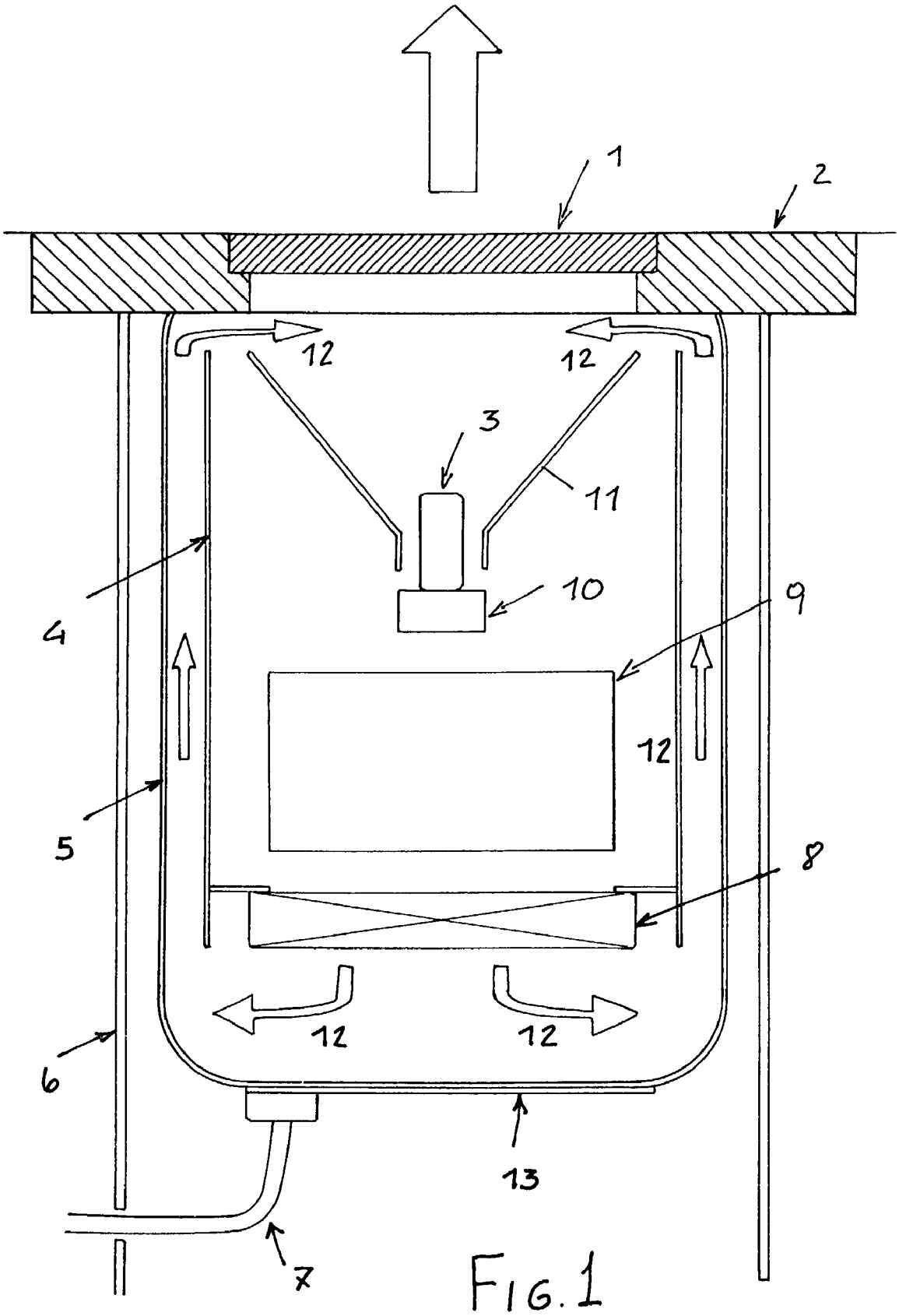
Figure 2:
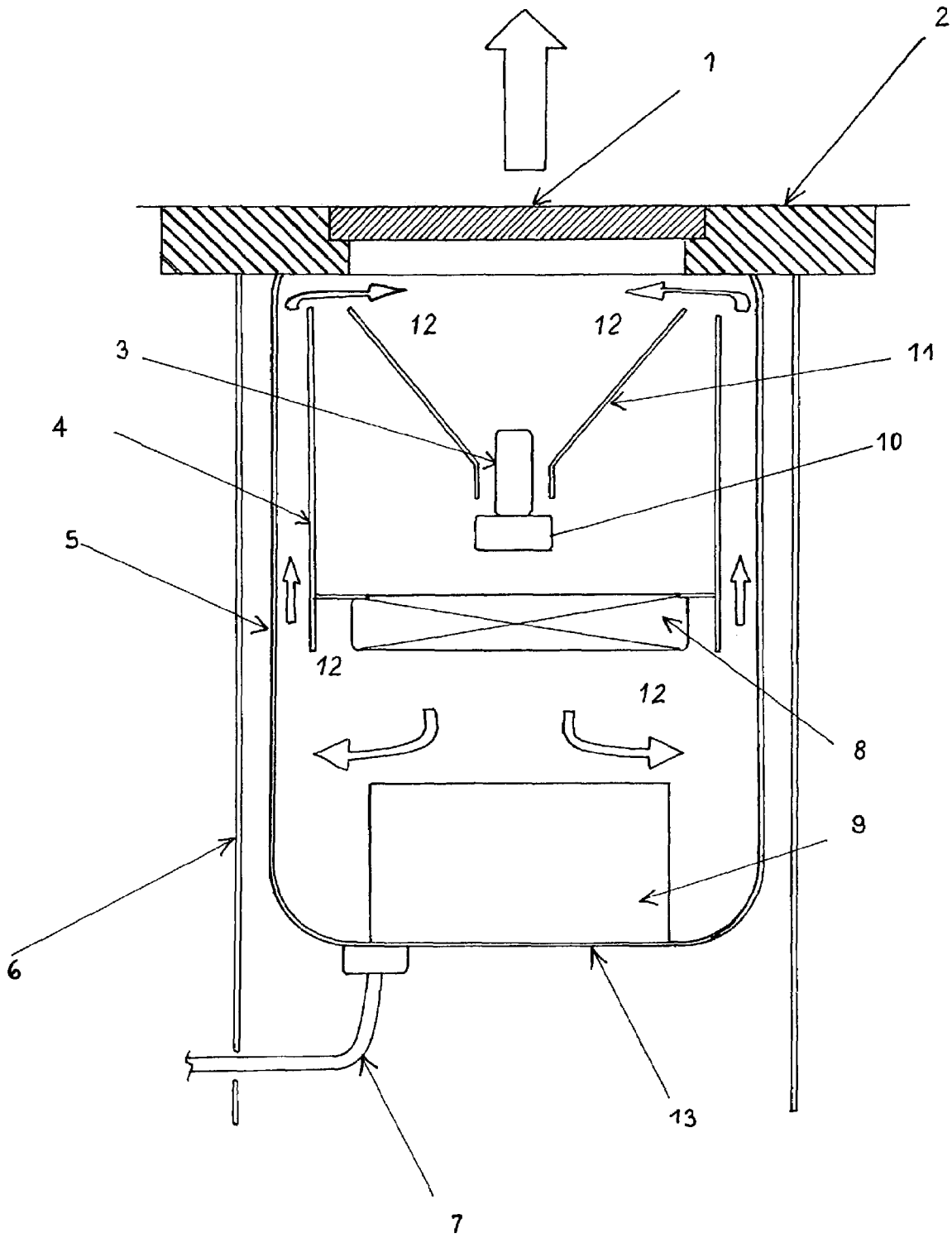
FIG. 2 shows a modified embodiment of the lighting device according to the invention.

With reference to the schematic diagram of FIG. 1, the invention, as stated, relates to a lighting device emitting a directional light beam.

Such a lighting device, in particular, is constituted by a sealed floodlight or lamp designed to be embedded into the ground.

In particular, the invention relates to a system designed for lowering the temperature of the translucid material (1) used for allowing the conveying of the light emitted by the lighting device, in order to prevent any scorching damages.

A fan (8) is herein provided for sucking the high temperature air heated because of its passage on the light source (3) and the components of the electric unit (9), to convey said air on the rear portion (13) of the body (5) constituting the outer casing of the lighting device. An air conveying or guiding system, comprising said body (5) and a tube (4) redirects the cooled air on the top portion of the device, thereby causing said air to circulate in a closed loop.

The light source, as stated, is preferably a discharge lamp operating based on an electric operating apparatus or unit also built-in in the lighting device.

The ground receiving volume, provided for receiving the lighting device, is delimited by a receiving or housing well (6).

The device comprises the above mentioned body (5) on which is mounted a disc element (2) supporting said translucid material (1) allowing the emitted light to be outward transmitted.

This translucid material is cooled by forced convection, owing to an air flow (12) providing an optimum thermal exchange.

The air return device, in particular, is constituted by said inner tube (4) which is concentrically arranged with respect to said body (5).

This device supports (the supporting functions being not shown in the schematic diagram) the optical reflector (11), light source (3) and its bush element (10) arranged at the focus of the reflector, the electric unit (9) operating the light source and the fan.

In this connection it should be pointed out that the assembling order of the electric unit (9) and fan (8) is not critical and can be reversed.

The suction provided by the fan (8) causes an air flow inside the tube (4).

The arrangement of the different component elements of the electric unit (9), such as the ballast element, capacitor and starter element is so designed as to facilitate the air circulation in the direction of the fan.

The air flow direction is not critical and can also be reversed.

The mechanical elements supporting the reflector, the light source and the electric components are provided with ports for allowing the air flow to easily flow therethrough in the direction of the fan.

After having passed through the tube and after heating because of its contact with the light source and the electric components, the air flow sucked by the fan (8) passes through the latter and is then caused to impinge on the bottom portion (13) of the body (5), thereby providing a thermal exchange with said body (5) by a forced convection type of exchanging.

The return path of air is provided owing to the circulation between the body (5) and tube (4), operating as an air guiding means.

The cable (7) provides an electric power supply means for operating the fan (8) and the supply unit of the light source (9).

Figure 3:
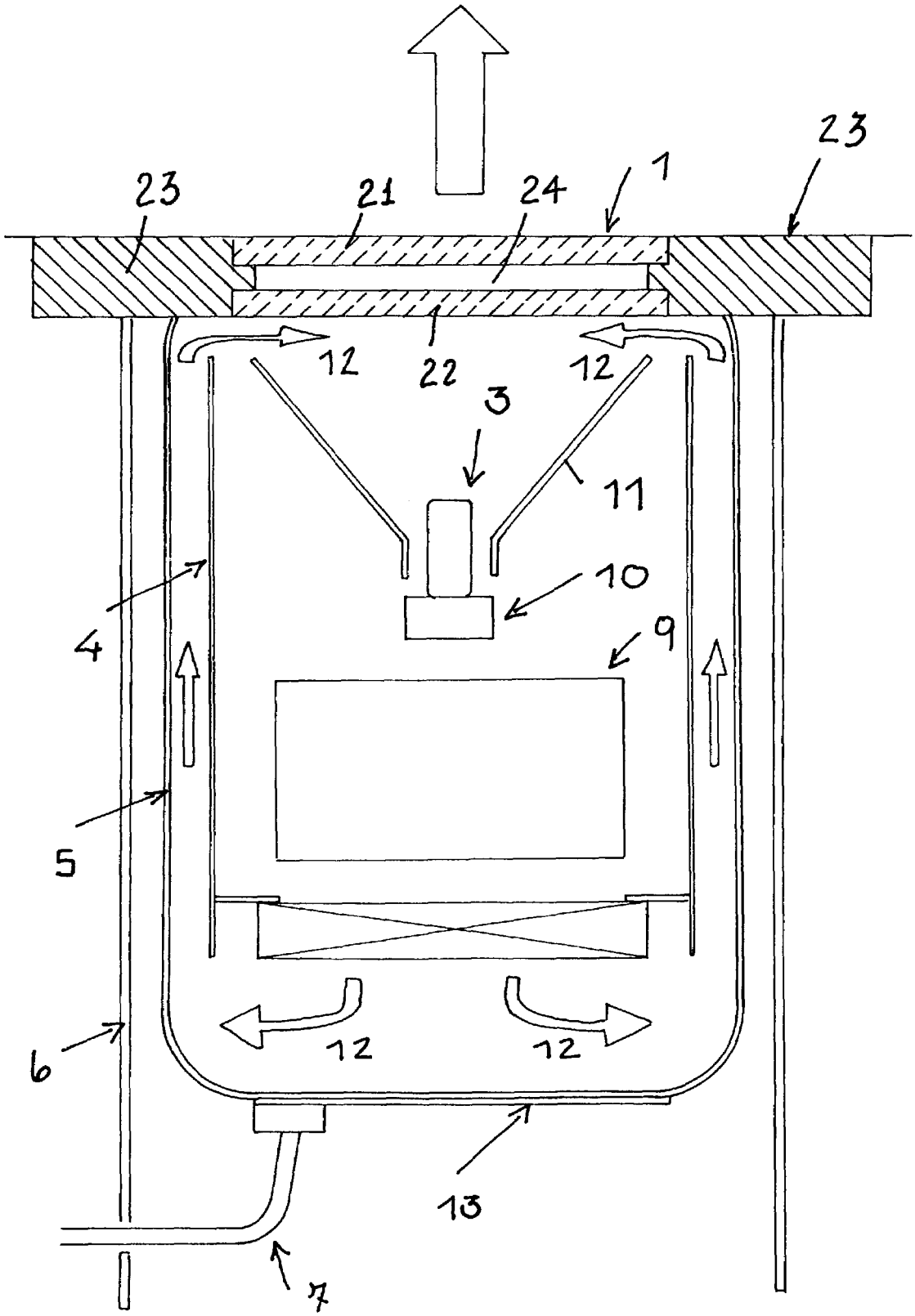
FIG. 3 shows a further modified embodiment of the lighting device according to the invention, provided with a double-glass element.
Figure 4:
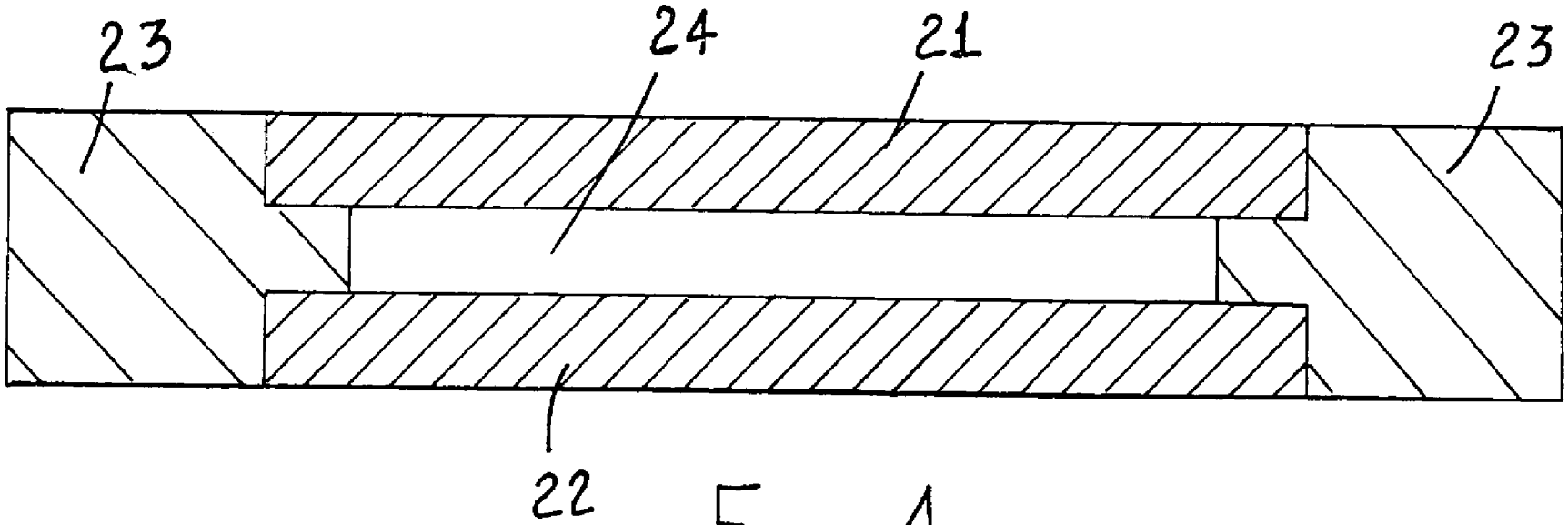
FIG. 4 shows a detail view of the double-glass element, which can be applied to the lighting device according to the invention to greatly reduce the temperature of the translucid material.

With reference to FIGS. 3 and 4, a modifying embodiment of the lighting device according to the invention is herein illustrated.

FIG. 3, in particular, show a lighting device including two translucid material layers (21 and 22).

As shown, the translucid material layers (21 and 22) are separated or spaced by a spacer element (23) advantageously made of an insulating material, thereby providing an insulating gap (24), to greatly reduce the temperature of the outer layer (21) of the translucid material.

It should be apparent that the lighting device according to the present invention can also be applied, in addition to an embedded place, also at different places near the ground, in particular spaced above the ground.

What is claimed is:

1. A floodlight comprising:

a sealed casing having an exterior wall, said casing containing air, a disc element supporting a translucid material and a tube spaced from the exterior wall;

said tube surrounds an optical reflector, a light source mounted at a focus of the reflector and aimed at the disc element, and a power supply unit for said light source;

said sealed casing further contains a fan that circulates the air through the tube and past the disc element.

2. The floodlight of claim 1 where the power supply unit is a battery.

3. The floodlight of claim 1 where at least a portion of the exterior wall comprises a material of increased thermal conductivity and the fan is aimed at at least the portion.

4. The floodlight of claim 1 where the light source is a discharge lamp.

5. The floodlight of claim 1 where the tube is concentrically mounted within the sealed casing.

6. The floodlight of claim 1 where the fan has reversible airflow.

7. The floodlight of claim 1 where the power supply unit further comprises a ballast, capacitor, and igniter where the power supply unit is configured to facilitate air flow through the casing.

8. The floodlight of claim 1 where the reflector and power supply unit further comprise ports to facilitate airflow within the floodlight.

9. The floodlight of claim 1 where the disc element further comprises two translucid material layers separated by an insulating gap and a spacing element of insulating material.

10. The floodlight of claim 1 where the sealed casing can be embedded in the ground.

11. A lamp comprising:

a sealed casing having an exterior wall supporting a disc element having two translucid material layers separated by an insulating gap and a spacing element of insulating material, said casing containing air and a tube spaced from the exterior wall;

said tube surrounds an optical reflector, a light source mounted at a focus of the reflector and aimed at the disc element, and a power supply unit for said light source;

said sealed casing further contains a fan that circulates the air through the tube and past the disc element.

12. The lamp of claim 11 where the insulating gap contains a partial vacuum.

13. A lighting device comprising:

a sealed casing having an exterior wall supporting a disc element, said casing containing air and a tube concentrically spaced from the exterior wall;

said tube surrounds an optical reflector, a light source mounted at a focus of the reflector and aimed at the disc element, and a power supply unit for said light source;

said sealed casing further contains a fan that circulates the air between the tube and the exterior wall and past the disc element.

* * * * *